US008226189B2

(12) United States Patent
Hattori et al.

(10) Patent No.: US 8,226,189 B2
(45) Date of Patent: Jul. 24, 2012

(54) LIQUID JETTING APPARATUS

(75) Inventors: Shingo Hattori, Nagoya (JP); Yoshitsugu Morita, Nagoya (JP); Narumi Kawai, Nagoya (JP); Hiroto Sugahara, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 311 days.

(21) Appl. No.: 12/608,218

(22) Filed: Oct. 29, 2009

(65) Prior Publication Data

US 2010/0110120 A1 May 6, 2010

(30) Foreign Application Priority Data

Oct. 31, 2008 (JP) ..... 2008-281236

(51) Int. Cl.
*B41J 29/38* (2006.01)
*B41J 29/393* (2006.01)

(52) U.S. Cl. ..... 347/9; 347/7; 347/19

(58) Field of Classification Search ..... 347/9, 6–7, 347/19

See application file for complete search history.

(56) References Cited

U.S. PATENT DOCUMENTS

| | | | | |
|---|---|---|---|---|
| 6,068,370 | A | 5/2000 | Miller et al. | |
| 6,123,407 | A | 9/2000 | Muraki | |
| 6,164,771 | A * | 12/2000 | Eckard et al. | 347/86 |
| 6,220,700 | B1 | 4/2001 | Haigo | |
| 6,422,693 | B2 | 7/2002 | Pawlowski, Jr. et al. | |
| 6,729,706 | B1 | 5/2004 | Patton et al. | |
| 6,832,864 | B2 | 12/2004 | Patton et al. | |
| 7,399,070 | B2 | 7/2008 | Nakamura et al. | |
| 2006/0028519 | A1 | 2/2006 | Nakamura et al. | |
| 2006/0083564 | A1 | 4/2006 | Yazawa et al. | |
| 2006/0125873 | A1 | 6/2006 | Nakajima | |
| 2007/0002090 | A1 * | 1/2007 | Arakawa | 347/16 |
| 2007/0242100 | A1 * | 10/2007 | Takuhara et al. | 347/43 |

FOREIGN PATENT DOCUMENTS

| | | |
|---|---|---|
| JP | 3150199 | 6/1991 |
| JP | 9-248916 | 9/1997 |
| JP | 11-277768 | 10/1999 |
| JP | 11277768 A * | 10/1999 |

(Continued)

OTHER PUBLICATIONS

Notice of Reasons for Rejection for Japanese Patent Application No. 2010-230289 dated Oct. 11 2011.

(Continued)

*Primary Examiner* — Jason Uhlenhake

(74) *Attorney, Agent, or Firm* — Fommer Lawrence & Haug LLP

(57) ABSTRACT

A liquid jetting apparatus includes a head having a nozzle which jets a liquid; a drive mechanism which reciprocately moves the head in a vertical direction to move the nozzle in the vertical direction; a nozzle protective member which is arranged in a moving area for the head and which protects the nozzle of the head; a controller which controls the drive mechanism to stop the head at a standby position which faces the nozzle protective member; a liquid container which contains the liquid; and a liquid tube which supplies the liquid to the head, and the liquid container is arranged such that, when the liquid container is filled with the liquid at a maximum capacity thereof, a liquid level of the liquid in the liquid container is same as or lower than a lowermost point of the nozzle in the head stopped at the standby position.

10 Claims, 9 Drawing Sheets

FOREIGN PATENT DOCUMENTS

| | | |
|---|---|---|
| JP | 2002-036583 | 2/2002 |
| JP | 2002362820 | 12/2002 |
| JP | 2003-285448 | 10/2003 |
| JP | 2005/262773 | 9/2005 |
| JP | 2005-262816 | 9/2005 |
| JP | 2005-288748 | 10/2005 |
| JP | 2005298082 | 10/2005 |
| JP | 2005-335246 | 12/2005 |
| JP | 2006-205655 | 8/2006 |

OTHER PUBLICATIONS

U.S. Office Action for U.S. Appl. No. 12/425,257 dated Nov. 9, 2011.

* cited by examiner

LIQUID JETTING APPARATUS

CROSS REFERENCE TO RELATED APPLICATION

The present application claims priority from Japanese Paten Application No. 2008-281236, filed on Oct. 31, 2008, the disclosure of which is incorporated herein by reference in its entirety.

BACKGROUND OF THE INVENTION

1. Field of the Invention

The present invention relates to a liquid jetting apparatus which is provided with a liquid jetting head having nozzles for jetting a liquid, and particularly to a liquid jetting apparatus which reciprocates the liquid jetting head in the vertical direction to move the nozzles in a vertical direction.

2. Description of the Related Art

An "ink-jet printer" has been widely known as a conventional "liquid jetting apparatus", and an example thereof has been disclosed in U.S. Pat. No. 7,399,070 B2 (corresponding to Japanese Patent Application Laid-open No. 2005-262816). An ink-jet printer (1) of U.S. Pat. No. 7,399,070 B2 includes an ink-jet head (30) having nozzles which jet an ink, a head holder (9) which also serves as a carriage, an endless belt (11) which reciprocates the head holder (9) in a horizontal direction, ink tanks 5*a*, 5*b*, 5*c*, and 5*d* (hereinafter, "ink tanks 5*a* to 5*d*") which accommodate the ink to be jetted from the nozzles, and tubes 14*a*, 14*b*, 14*c*, and 14*d* (hereinafter, "tubes 14*a* to 14*d*") which supply the ink in the ink tanks 5*a* to 5*d*, to the nozzles. The ink jet printer (1) adopts a "tube supply method" of supplying the ink in the ink tanks 5*a* to 5*d* via the tubes 14*a* to 14*d*. Therefore, it is possible to make the ink tanks 5*a* to 5*d* large, and to prolong an ink replenishment cycle. Accordingly, it is possible to ease a troublesome task of ink replenishment. However, since the ink-jet head (30) is reciprocated in the horizontal direction, an installation area of the ink-jet printer in the "horizontal direction" becomes substantial, and an installation site is constrained remarkably, which has been a problem.

As a means for solving such problem, a "vertical" ink-jet printer (100) has been disclosed in Japanese Patent Application Laid-open No. 2005-298082. In the vertical ink-jet printer (100), a carriage (151) is reciprocated in the vertical direction by installing a carriage guide shaft (156) to be extended in the vertical direction, and accordingly, a recording head (152) is moved in the vertical direction.

The reference numerals in brackets correspond to reference numerals used in U.S. Pat. No. 7,399,070 and Japanese Patent Application Laid-open No. 2005-298082.

According to the ink-jet printer (100) in Japanese Patent Application Laid-open No. 2005-298082, by narrowing the installation area in the "horizontal direction", it is possible to reduce the constraints on the installation site. However, a positional relationship of nozzles of the recording head (152) and a liquid level in an ink container has not been taken into consideration.

SUMMARY OF THE INVENTION

The present invention is made for solving the abovementioned issue, and an object of the present invention is to provide a liquid jetting apparatus in which it is possible to prevent the liquid from leaking out from the nozzle by preventing a "positive pressure" due to a gravitational force from acting on the liquid inside the liquid jetting head.

Moreover, an object of the present invention is to provide a liquid jetting apparatus in which it is possible to prevent jetting characteristics from deteriorating, by preventing an excessive "negative pressure" due to the gravitational force from acting on the liquid inside the liquid jetting head.

According to first aspect of the present invention, there is provided a liquid jetting apparatus which jets a liquid, including: a liquid jetting head having a nozzle which jets the liquid; a drive mechanism which reciprocately moves the liquid jetting head in a vertical direction to move the nozzle in the vertical direction; a nozzle protective member which is arranged in a moving area for the liquid jetting head and which protects the nozzle of the liquid jetting head; a controller which controls the drive mechanism to stop the liquid jetting head at a standby position which faces the nozzle protective member; a liquid container which contains the liquid; and a liquid tube which supplies the liquid in the liquid container to the liquid jetting head, and the liquid container is arranged such that, when the liquid container is filled with the liquid at a maximum capacity thereof, a position of a liquid level of the liquid in the liquid container is same as or lower than a position of a lowermost point of the nozzle in the liquid jetting head which is stopped at the standby position.

When the liquid level in the liquid container is at an upper side than the nozzle in the liquid jetting head which is stopped at the standby position, since a "positive pressure" due to a gravitational force acts on the liquid in the liquid jetting head, there is a possibility that a meniscus of the nozzle is destroyed and the liquid leaks out. In the first aspect of the present invention, the position of the liquid level when the liquid container is filled with the liquid at maximum capacity thereof is same as or lower than the position of the lowermost point of the nozzle in the liquid jetting head which is stopped at the standby position. Therefore, in the liquid jetting head which is stopped at the standby position, the "positive pressure" due to the gravitational force does not act on the liquid inside the liquid jetting head, and it is possible to prevent the liquid from leaking out from the nozzle.

The "lowermost point of the nozzle" means a point positioned at the lowest portion in the vertical direction of a minimum-diameter portion of the nozzle. When there exists a plurality of nozzles for one liquid container, it means the point positioned at the lowest portion in the vertical direction of the minimum-diameter portion of a nozzle at the lowest position among the nozzles. For instance, when an inner circumferential surface of the nozzle is in a taper form with a diameter thereof decreased gradually toward a downstream side, a jetting port positioned at the most downstream position is the "minimum-diameter portion", and a point positioned at the lowest portion in the vertical direction in the jetting port is the "lowest point of the nozzle".

According to a second aspect of the present invention, there is provided a liquid jetting apparatus which jets a liquid toward a jetting objective, including: a liquid jetting head having a nozzle which jets the liquid onto the jetting objective; a drive mechanism which reciprocately moves the liquid jetting head in a vertical direction to move the nozzle in the vertical direction; a nozzle protective member which is arranged in a moving area for the liquid jetting head and which protects the nozzle of the liquid jetting head; a controller which controls the drive mechanism to stop the liquid jetting head at a standby position facing the nozzle protective member; a liquid container which contains the liquid; and a liquid tube which supplies the liquid in the liquid container to the liquid jetting head, and both the liquid jetting head which is stopped at the standby position and the liquid container are arranged at one of an upper side and a lower side of a transporting path through which the jetting objective is transported in a horizontal direction.

Even when the level of the liquid in the liquid container is lower than the nozzle, in a case in which a vertical interval (in other words, a water head difference) is excessively large, an excessively large "negative pressure" due to the gravitational force acts on the liquid in the liquid jetting head. Therefore, there is a possibility that the meniscus in the nozzle is destroyed, and the air is sucked into the nozzle, thereby degrading the jetting characteristics. In the second aspect of the present invention, both the liquid container and the liquid jetting head which is stopped at the standby position are arranged at one of the upper side or the lower side of the transporting path. Therefore, it is possible to make small the vertical interval between the level of the liquid in the liquid container and the lowest point of the nozzle, and to prevent the excessively large "negative pressure" due to the gravitational force from acting on the liquid in the liquid jetting head, from acting. Consequently, it is possible to prevent the degradation of the jetting characteristics due to the air being sucked into the nozzle.

DETAILED DESCRIPTION OF THE PREFERRED EMBODIMENTS

A liquid jetting apparatus according exemplary embodiments of the present invention will be described below while referring to the accompanying diagrams.

Figure 1:
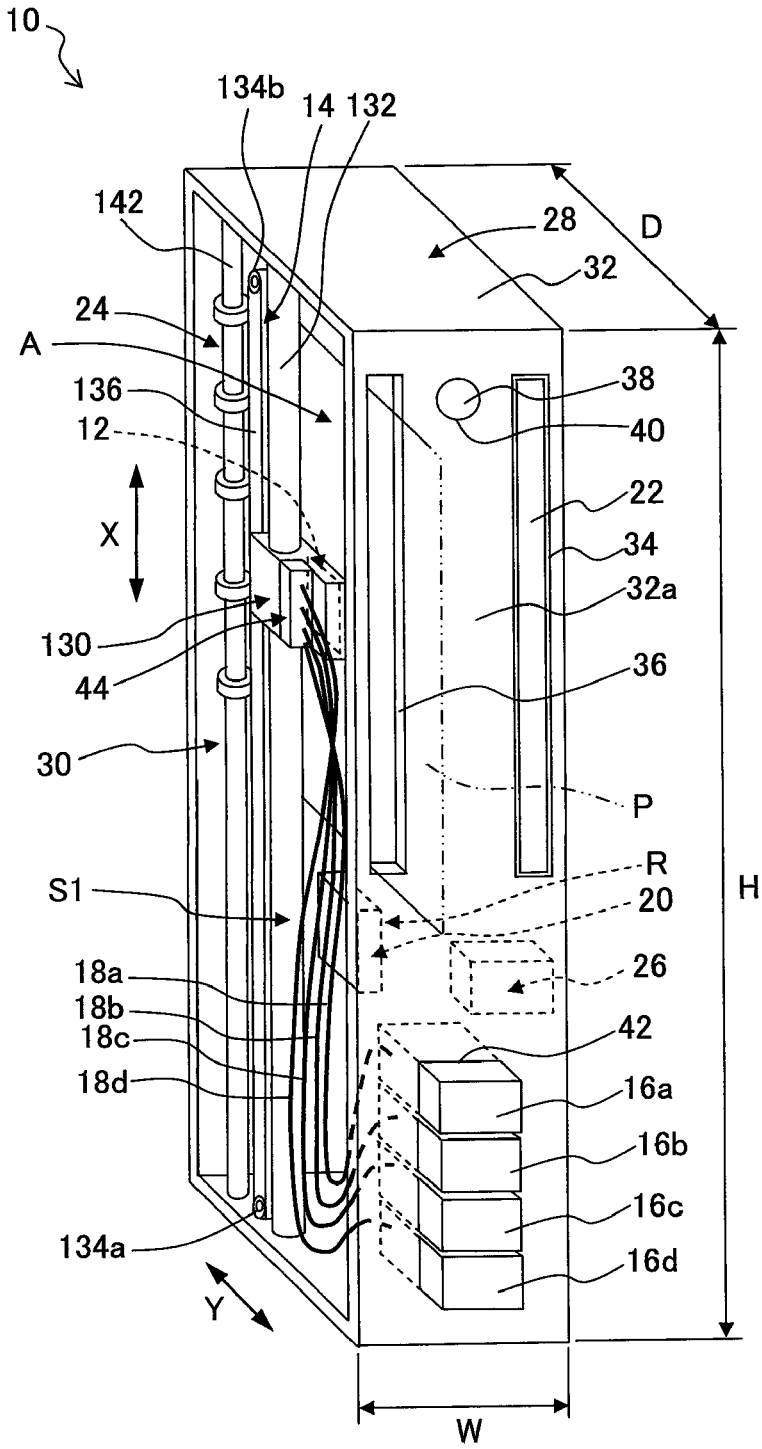
FIG. 1 is a perspective view showing an overall structure of an ink-jet printer according to a first embodiment.

An ink-jet printer 10, as shown in FIG. 1, includes an ink jet head 12 (a liquid jetting head), a drive mechanism 14 which reciprocates the ink-jet head 12 in a vertical direction, ink containers 16*a*, 16*b*, 16*c*, and 16*d* (hereinafter, "ink containers 16*a* to 16*d*") (liquid containers), ink tubes 18*a*, 18*b*, 18*c*, and 18*d* (hereinafter, "ink tubes 18*a* to 18*d*") (liquid tubes), a nozzle cap 20 (a nozzle protective member), a paper tray 22 which accommodates papers P (jetting objective), a paper transporting section 24 (transporting mechanism) which transports the paper P, a controller 26 which carries out various controls, and a casing 28.

In a first embodiment, a structure (including a mutual positional relationship) of the ink jet head 12, the drive mechanism 14, the nozzle cap 20, and the ink containers 16*a* to 16*d* in the casing 28 is particularly important. Therefore, the following description is made by referring mainly to these structural components.

A "main scanning direction X" used in the following description means a direction of movement of the ink-jet head 12 (in other words, a vertical direction), and a "secondary scanning direction Y" means a direction in which the paper P is discharged (in other words, a horizontal direction).

As shown in FIG. 1, although a width W of the casing 28 is set to be sufficiently small with respect to a height H and a depth D, the width W is set to a size such that the casing 28 stands stably. Moreover, the casing 28 has a main body 32 which has a box shape and has an opening portion 30 formed in an entire surface on one side in a direction of width thereof (in other words, a side surface at a left side in FIG. 1), and a lid (omitted in the diagram) having a substantially quadrangular plate shape, which closes the opening portion 30. A transporting path A which is substantially U-shaped in a plan view is formed in a space spanned from a central portion up to an upper portion in the casing 28. Moreover, a paper-tray insertion opening 34 which is an entrance of the transporting path A, a discharge opening 36 which is an exit of the transporting path A, a switch installing hole 40 in which a power supply switch 38 is installed, and an ink container installing hole 42 in which the ink containers 16*a* to 16*d* are installed are formed in a front-surface panel 32 which constructs a front surface of the main body 32 (in other words, a surface at a frontward side in FIG. 1).

Moreover, the abovementioned components are installed in the casing 28 while taking into consideration the mutual positional relationship. In other words, as shown in FIG. 1, the paper tray 22, the paper transporting section 24, the drive mechanism 14, and the ink jet head 12 are installed in this order from an upstream side of the transporting path A, and the nozzle cap 20 and the ink containers 16*a* to 16*d* are installed in a lower-side area S1 positioned at a lower side of the transporting path A. A buffer portion 44 is installed on the ink-jet head 12, and end portions at a downstream side of the ink tubes 18*a* to 18*d* are connected to the buffer portion 44, and also end portions at an upstream side thereof are connected to the ink containers 16*a* to 16*d* respectively. Furthermore, the controller 26 is installed at a predetermined location in the casing 28.

Figure 5:
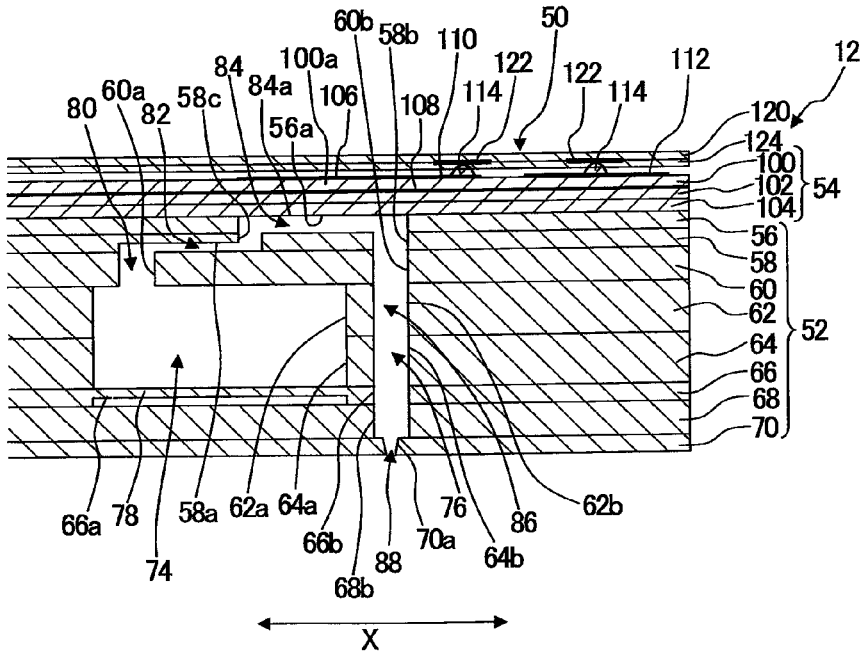
FIG. 5 is a cross-sectional view taken along a line V-V in FIG. 4 of the ink-jet head and the FPC in FIG. 4.

The ink-jet head 12 is mounted on a carriage 130 in the drive mechanism 14 (FIG. 1 and FIG. 2), and reciprocates in the vertical direction (in other words, the main scanning direction X). The ink-jet head 12 jets selectively inks of four colors for image formation based on a drive voltage which is applied from a flexible printed circuit (hereinafter, flexible printed circuit is abbreviated as "FPC") 50. As shown in FIG. 3 and FIG. 5, the ink jet head 12 includes a channel unit 52 and an actuator unit 54.

A word "downward" used in the description of the FPC 50 and the ink-jet head 12 means a direction in which ink is jetted from the nozzle, and "upward" means a direction opposite thereof.

The channel unit 52, as shown in FIG. 5, includes a pressure chamber plate 56, an aperture plate 58, a connecting channel plate 60, a first manifold plate 62, a second manifold plate 64, a damper plate 66, a cover plate 68, and a nozzle plate 70 (also called as "eight plates 56 to 70"), and these eight plates 56 to 70 are stacked in the abovementioned order from an upper side. By connecting recesses and holes formed in the eight plates 56 to 70 being continued (being connected), four ink channels N1, N2, N3, and N4 (hereinafter, "ink channels N1 to N4") corresponding to inks of four colors namely black (BK), yellow (Y), cyan (C), and magenta (M) respectively are formed as shown in FIG. 3 and FIG. 4.

The four ink channels N1 to N4 are arranged to be aligned from a lower side to an upper side in a vertical direction, in an ascending order of surface tensions of the inks flowing through the ink channels N1 to N4. Among the inks of four colors used in the first embodiment, a surface tension of the black (BK) ink is the lowest, a surface tension of the yellow (Y) ink is the second lowest, a surface tension of the cyan (C) ink is the third lowest, and a surface tension of the magenta (M) is the highest. Therefore, the ink channels N1 to N4 are arranged to be aligned from the lower side to the upper side in the vertical direction, in this order of the ink colors.

Figure 4:
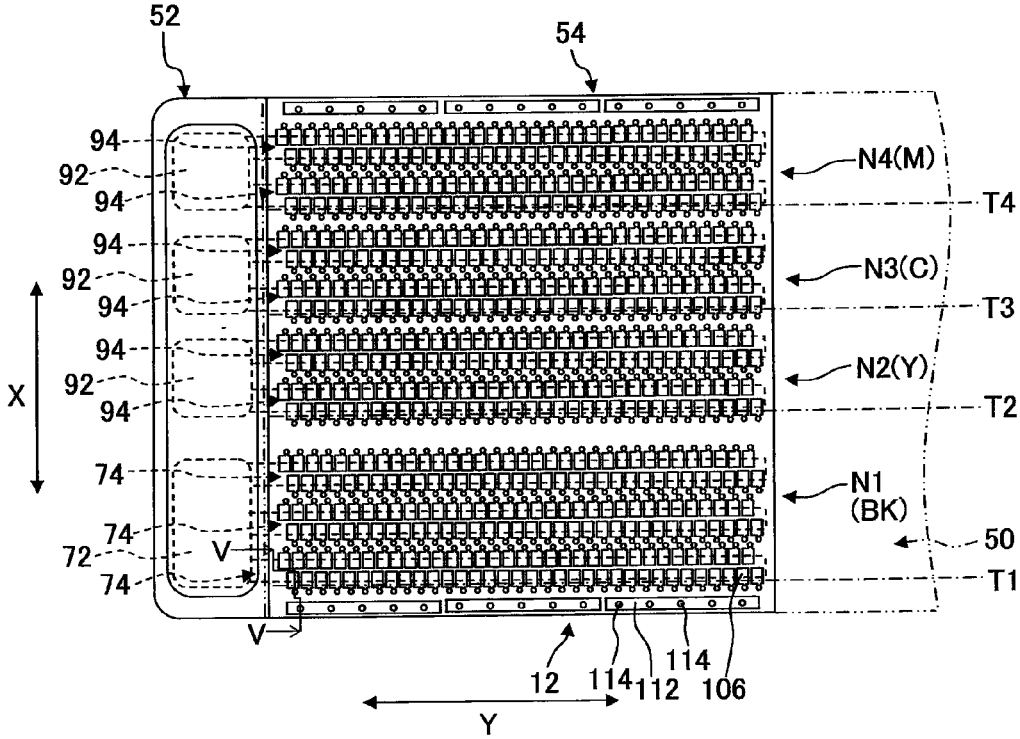
FIG. 4 is a plan view showing the ink-jet head which forms the ink-jet printer according to the first embodiment.

The ink channel N1 positioned at the lowermost position, includes one ink infusing channel 72 and a plurality (three in the first embodiment) of common ink chambers 74 which communicate with the ink infusing channel 72, as shown in FIG. 4, and a plurality (68 in the first embodiment) of individual ink channels 76 which communicate with the common ink chambers 74 respectively, as shown in FIG. 5.

The ink infusing channel 72 is formed by holes (omitted in the diagram) formed in the pressure chamber plate 56, the aperture plate 58, the connecting channel plate 60, the first manifold plate 62, and the second manifold plate 64, being connected in a thickness direction of the channel unit 52, at one end portion in the secondary scanning direction of the channel unit 52.

Figure 6:
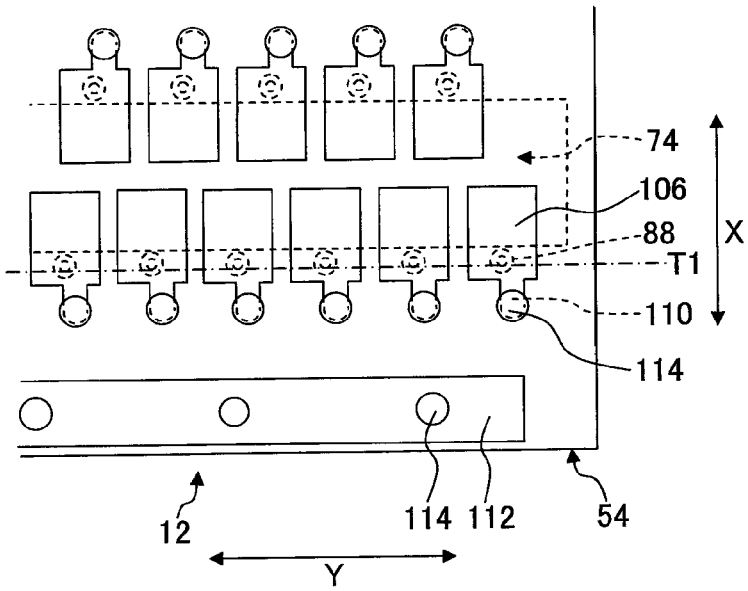
FIG. 6 is a partially enlarged plan view showing the ink jet head which forms the ink-jet printer according to the first embodiment.

The common ink chamber 74, as shown in FIG. 5, is formed by holes 62*a* and 64*a* formed in the first manifold plate 62 and the second manifold plate 64 being connected in a thickness direction of the first manifold plate 62 and the second manifold plate 64. A side cross-sectional shape of the common ink chamber 74 is designed to be a rectangle extending in the main scanning direction X. Moreover, as shown in FIG. 4, the common ink chamber 74 is designed to be a rectangle extending in the secondary scanning direction Y, in a plan view. An end portion at one side in the secondary scanning direction Y of the common ink chamber 74 communicates with the ink infusing channel 72, and an end portion at the other side is blocked. Moreover, at a bottom portion of the common ink chamber 74, a damper 78 in a plate form is formed by forming a recess 66*a* in a lower surface of the damper plate 66 as shown in FIG. 5. In a plan view, a plurality of nozzles 88 is formed in a zigzag form, to be aligned in two rows as shown in FIG. 6 on both sides of a width direction of (the main scanning direction X) of each common ink chamber 74 in a plan view.

The individual ink channel 76 is a channel for making the ink inside the common ink chamber 74 jet to an outside. Each individual ink channel 76, as shown in FIG. 5, is formed by a connecting channel 80, an aperture 82, a pressure chamber 84, a jetting channel 86, and a nozzle 88 being communicated in the abovementioned order from an upstream side.

The connecting channel 80 is formed at an upper side of the common ink chamber 74 by a hole 60*a* formed in the connecting channel plate 60. The aperture 82 is formed at an upper side of the connecting channel 80 by a recess 58*a* formed in a lower surface of the aperture plate 58. The pressure chamber 84 is formed at an upper side of the aperture 82, by a hole 56*a* formed in the pressure chamber plate 56. Moreover, the jetting channel 86 is formed at a lower side of the pressure chamber 84 by holes 58*b*, 60*b*, 62*b*, 64*b*, 66*b*, and 68*b* formed in the aperture plate 58, the connecting channel plate 60, the first manifold plate 62, the second manifold plate 64, the damper plate 66, and the cover plate 68 respectively. The nozzle 88 is formed at a lower side the jetting channel 86 by a hole 70*a* having a taper shape, in the nozzle plate 70.

Moreover, an end portion at the upstream side of the aperture plate 82 and the common ink chamber 74 communicate via the connecting channel 80. An end portion at the downstream side of the aperture 82 and an end portion at the upstream side of the pressure chamber 84 communicate via a hole 58*c* formed in the aperture plate 58. An end portion at the downstream side of the pressure chamber 84, and the nozzle 88 communicate via the jetting channel 86. Furthermore, an opening portion 84*a* is formed at an upper end portion of the pressure chamber 84, and the opening portion 84*a* is blocked by a lower surface of the actuator unit 54.

On the other hand, as shown in FIG. 3 and FIG. 4, the ink channels N2, N3, and N4 (hereinafter, "ink channels N2 to N4") include one ink infusing channel 92, a plurality (two in the first embodiment) of common ink chambers 94 which communicate with the ink infusing channel 92, and a plurality (68 in the first embodiment) of individual ink channels 96 which communicate with the common ink chambers 94 respectively.

The ink infusing channel 92 is formed similarly as the ink infusing channel 72, except for a point that a volume of the ink infusing channel 92 is smaller than a volume of the ink infusing channel 72 of the ink channel N1. The common ink chambers 94 and the individual ink channels 96 are formed similarly as the common ink chambers 74 and the individual ink channels 76 of the ink channel N1, except for a point that the total number of the common ink chambers 94 and the individual ink channels 96 is smaller than the total number of the common ink chambers 74 and the individual ink channels 76 respectively. Accordingly, for all the ink channels N1 to N4, a uniformity of an ink jetting characteristics is retained, and a "balance of an amount of ink (to be) jetted" is facilitated. In other words, the "ink jetting characteristics sought in the ink channels N2 to N4 are common to the "ink jetting characteristics" sought in the ink channel N1. Therefore, the structures of the ink infusing channel 92, the common ink chambers 94, and the individual ink channels 96 which form the ink channels N2 to N4 are designed similarly as the structures of the ink infusing channel 72, the common ink chambers 74, and the individual ink channels 76 which form the ink channel N1. Moreover, a frequency of use of the ink which flows through the ink channels N2 to N4 is generally lower than a frequency of use of the black (BK) ink which flows through the ink channel N1. Therefore, the total number of the common ink chambers 94 and the individual ink channels 96 forming each of the ink channels N2 to N4 is designed to be smaller than the total number of the common ink chambers 74 and the individual ink channels 76 forming the ink channel N1.

Moreover, as shown in FIG. 3 and FIG. 4, a filter 98 which traps impurities and air bubbles mixed in the ink is joined by an adhesive etc. to an area on an upper surface of the channel unit 52 at which the ink infusing channels 72 and 92 are formed. The actuator unit 54 is joined by an adhesive etc. to an area on the upper surface of the channel unit 52 different from the area to which the filter 98 is joined.

In this manner, in the first embodiment, the four ink channels N1 to N4 corresponding to the inks of four colors namely black (BK), yellow (Y), cyan (C), and magenta (M) are arranged to be aligned from a lower side to an upper side in the vertical direction in ascending order of the surface tension of the ink flowing through the channels. Consequently, the nozzles 88 provided to the ink channels N1 to N4 respectively, in other words, the nozzles 88 corresponding to the ink containers 16*a* to 16*d* respectively, are also arranged to be aligned from the lower side to the upper side in the vertical direction in the ascending order of the surface tension of the ink to be jetted from the nozzle.

Moreover, in each of the ink channels N1 to N4, a plurality of nozzle rows, each of which is formed by a plurality of nozzles 88 aligned in the secondary scanning direction Y, are arranged in the main scanning direction X as shown in FIG. 6. In the nozzles 88, since the diameter of the inner circumferential surface is decreased gradually toward the downstream side as shown in FIG. 5, the jetting port positioned at the most downstream side is a "minimum diameter portion". Consequently, a point positioned at a lowest portion in the vertical direction in the jetting port of the nozzle 88 forming the lowermost nozzle row in the main scanning direction X becomes the lowermost point of the nozzle. Moreover, the positional arrangement of the ink containers 16*a* to 16*d* is designed upon taking into consideration a relationship with the lowermost point of the nozzle. In FIG. 4, heights T1, T2, T3, and T4 (hereinafter, "heights T1 to T4") of the lowermost point of the nozzle in each of the ink channels N1 to N4 are indicated by alternate long and short dash lines.

The actuator unit 54, as shown in FIG. 5, forms an upper surface of the pressure chamber 84 in the channel unit 52, and imparts selectively a jetting pressure to the ink in the pressure chamber 84. The actuator unit 54 is formed by stacking a first piezoelectric sheet 100, a second piezoelectric sheet 102, and a third piezoelectric sheet 104 in this order from an upper side.

Each of the first piezoelectric sheet 100, the second piezoelectric sheet 102, and the third piezoelectric sheet 104 is formed of a ceramics material of lead zirconium titanate (PZT) which is a ferroelectric substance, and is a sheet member having a thickness about 10 μm to 30 μm. A plurality of individual electrodes 106 corresponding to the pressure chambers 84 respectively is formed on an upper surface of the first piezoelectric sheet 100 which is the uppermost layer, at positions facing the pressure chambers 84. A common electrode 108 corresponding commonly to the pressure chambers 84 is formed on an upper surface of the second piezoelectric sheet 102 which is an intermediate layer, spreading over the pressure chambers 84. Consequently, in the actuator unit 54, the first piezoelectric sheet 100 is an active layer, and a portion of the first piezoelectric sheet 100 sandwiched between the individual electrode 106 and the common electrode 108 is an active portion 100*a*.

Moreover, as shown in FIG. 5 and FIG. 6, an individual electrode terminal 110 and a common electrode terminal 112 are formed on the upper surface of the first piezoelectric sheet 100 which is the uppermost layer. The individual electrode terminal 110 and the individual electrode 106 are electrically connected, and the common electrode terminal 112 and the common electrode 108 are electrically connected via an electroconductive substance (omitted in the diagram) which is pierced through the first piezoelectric sheet 100. An electroconductive bump 114 having a substantially hemispherical shape, which is made of a metallic material including a metal such as Ag (silver), is formed on a surface of the individual electrode terminal 110 and the common electrode terminal 112.

The FPC 50, as shown in FIG. 3 and FIG. 5, includes a base material 120 which is made of a flexible synthetic resin material (such as a polyimide resin, a polyester resin, and a polyamide resin), a plurality of wires 122 made of an electroconductive metallic material (such as a copper foil), an electric insulating layer 124 which is made of a flexible synthetic resin material (such as a polyimide resin, a polyester resin, and a polyamide resin), and a driver IC 126 which is arranged at a predetermined location on an upper surface of the base material 120, and which is brought into electrical conduction with each of the wires 122. The wires 122 are formed on a lower surface of the base material 120, and the electric insulating layer 124 is formed on the lower surface of the base material 120 to cover the wires 122. Moreover, the electroconductive bump 114 which is formed on the individual electrode terminal 110 and the common electrode terminal 112 is electrically connected to the wire 122 associated with a terminal portion on an output side of the FPC 50.

The drive mechanism 14 reciprocates the ink-jet head 12 in the vertical direction (in other words, the main scanning direction X) to move the nozzles 88 in the vertical direction. The drive mechanism 14, as shown in FIG. 1 and FIG. 2, includes the carriage 130, a sliding shaft 132, a main drive pulley 134*a*, a driven pulley 134*b*, a drive belt 136 in the form of a ring, and a drive motor 138.

Figure 2:
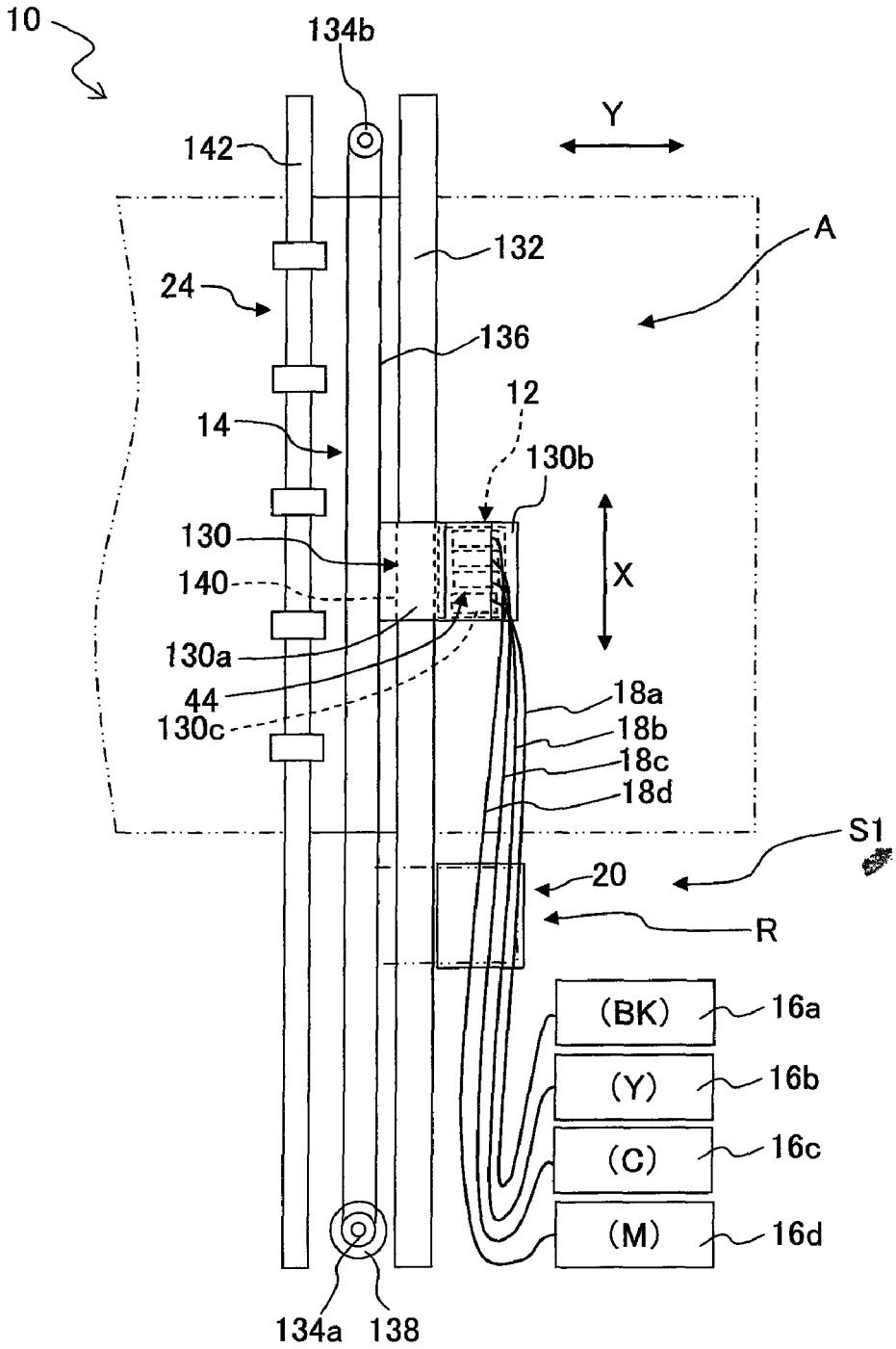
FIG. 2 is a simplified diagram showing a structure of an interior of the ink jet printer according to the first embodiment.
Figure 3:
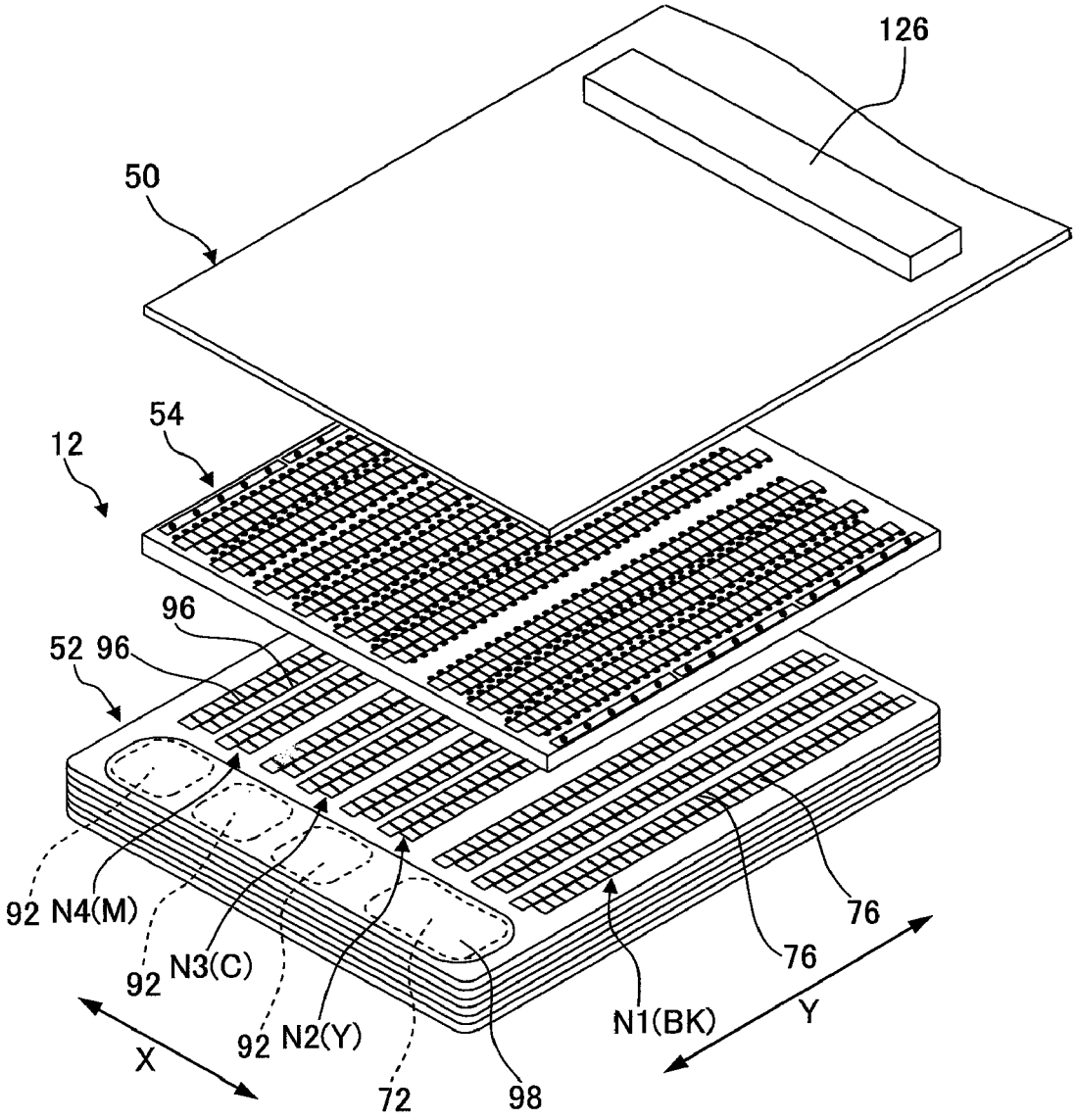
FIG. 3 is an exploded perspective view showing an ink-jet head and a flexible printed circuit (board) which is joined to the ink-jet head, which form the ink-jet printer according to the first embodiment.

The carriage 130, as shown in FIG. 2, includes an attaching portion 130*a* having a through hole 140 extending in the vertical direction, a head mounting portion 130*b* on which the ink-jet head 12 is mounted, and a buffer mounting portion 130*c* on which a buffer portion 44 is mounted. The sliding shaft 132 extending in the vertical direction is inserted through the through hole 140. A pair of pulleys namely the main drive pulley 134*a* and the driven pulley 134*b* is arranged to be separated by a distance in the vertical direction behind the sliding shaft 132 (left side in FIG. 2), and the drive belt 136 in the form of a ring is put around the main drive pulley 134*a* and the driven pulley 134*b*, along the sliding shaft 132. The carriage 130 is fixed to the drive belt 136 by using a fixing member such as a screw. A rotating shaft of the drive motor 138 is connected to the main drive pulley 134*a*, and the controller 26 shown in FIG. 1 is electrically connected to the drive motor 138.

When the drive motor 138 is rotated based on a drive signal which is outputted from the controller 26, the main drive pulley 134*a* and the drive belt 136 are rotated, and the carriage 130 fixed to the drive belt 136 is moved toward a vertically upward direction or a vertically downward direction. Accordingly, the ink-jet head 12 reciprocates in the vertical direction (in other words, the main scanning direction X), and the nozzles 88 of the ink jet head 12 are moved in the vertical direction.

In a case of putting OFF a power supply of the ink-jet printer 10, or in a case of making the ink jet head 12 wait temporarily, the drive motor 138 is rotated based on a stop signal imparted from the controller 26, and the ink-jet head 12 is stopped at a predetermined standby position R within a moving area for the ink-jet head 12.

The nozzle cap 20 protects the nozzles 88 of the ink-jet head 12 at the standby position R. Moreover, the nozzle cap 20 is also used for sucking the ink from the nozzle 88 for recovering the jetting characteristics which are deteriorated. A pump unit (omitted in the diagram) which generates a negative pressure for sucking the ink is connected to the nozzle cap 20.

In the first embodiment, the nozzle cap 20 is arranged in a lower-side area S1 positioned at a lower side of the transporting path A, and this position of the nozzle cap 20 is the standby position R. Consequently, both the ink-jet head 12 stopped at the standby position R and the ink containers 16*a* to 16*d* are arranged in the lower-side area S1 positioned at a lower side of the transporting path A.

Figure 7:
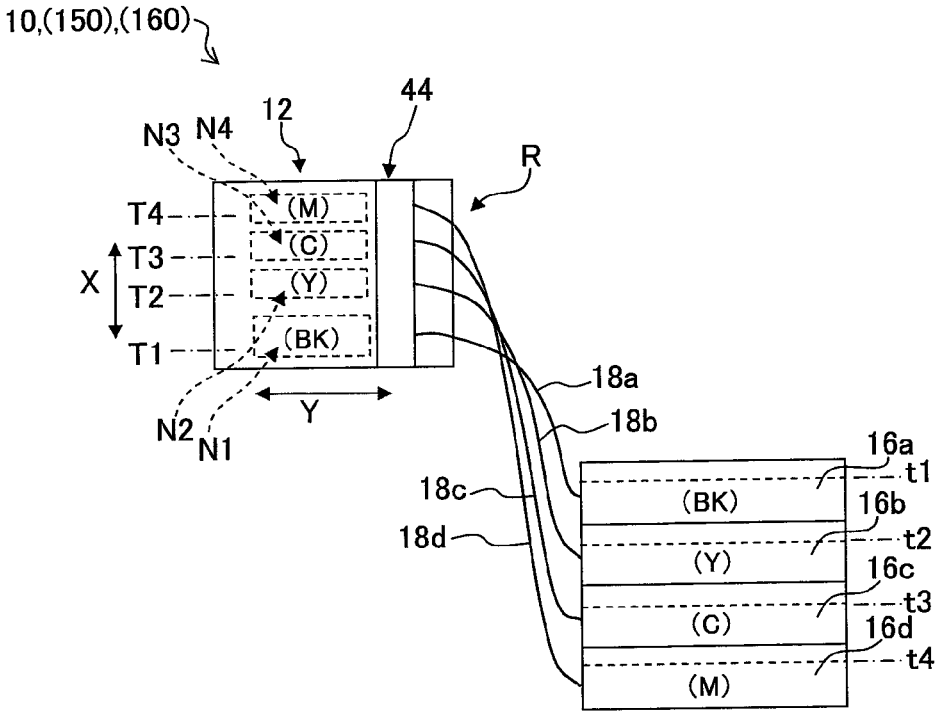
FIG. 7 is a schematic diagram showing main components of the ink-jet printer according to the first embodiment.

The ink containers 16*a* to 16*d* are containers which contain four types of inks having different surface tension. The ink containers 16*a* to 16*d*, as shown in FIG. 7, are arranged such that, heights t1, t2, t3, and t4 (hereinafter, "heights t1 to t4") of the liquid level when the ink containers 16*a* to 16*d* are filled with the inks at maximum capacity thereof respectively (hereinafter, called as "maximum liquid-level height") are same as or lower than the heights T1 to T4 of the lowermost point of the nozzle in the ink-jet head 12 which is stopped at the standby position R. Consequently, in the ink-jet head 12 which is stopped at the standby position R, a positive pressure due to a gravitational force does not act on the inks in the ink-jet head 12, and it is possible to prevent the ink from leaking out from each of the nozzles 88 of the ink channels N1 to N4.

Moreover, the ink containers 16*a* to 16*d* are arranged to be aligned from the upper side to the lower side in the vertical direction in the ascending order of the surface tensions of the inks accommodated in the ink containers 16*a* to 16*d*. Among the four types of inks used in the first embodiment, the surface tension of the black (BK) ink is the lowest, the surface tension of the yellow (Y) ink is the second lowest, the surface tension of the cyan (C) ink is the third lowest, and the surface tension of the magenta (M) ink is the highest. Therefore, the ink containers 16*a* to 16*d* are arranged to be aligned from the upper side to the lower side in the vertical direction in this order of surface tensions of the inks. Consequently, for the ink having a small surface tension such as the black (BK) ink, it is possible to reduce the vertical interval (in other words, the water head difference) between the maximum liquid-level height t1 and the height T1 of the lowermost point of the nozzle in the ink-jet head 12 which is stopped at the standby position R, and to prevent an excessive negative pressure from acting on the ink.

Moreover, as shown in FIG. 7, the ink containers 16*a* to 16*d* and the ink channels N1 to N4 of the ink-jet head 12 are connected via the ink tubes 18*a* to 18*d* and the buffer portion 44. The buffer portion 44 has four ink storage portions (omitted in the diagram) which are interposed between the ink tubes 18*a* to 18*d* and the ink channels N1 to N4, and the pressure which acts on the ink in the ink-jet head 12 is relieved in the ink storage portion.

The paper tray 22 is a container which accommodates a plurality of papers P by letting a paper surface of the papers P to be orthogonal to a horizontal surface. A shape of the paper tray 22 as viewed from a side (a shape when viewed from a left side or a right side in FIG. 1) is almost same as a shape of the paper P (quadrangle). Moreover, a shape of the paper tray 22 as viewed from a front (a shape when viewed from a frontward side in FIG. 1) is almost same as a shape of the paper-tray insertion opening 34 (quadrangle) in the casing 28. The paper tray 22 is inserted into the casing 28 from the paper-tray insertion opening 34, and is drawn out from the casing 28 through the paper-tray insertion opening 34.

The paper transporting section 24 includes a pickup roller (omitted in the diagram) which takes one-by-one the papers P accommodated in the paper tray 22, and a transporting roller 142 which has a rotating shaft extending in the vertical direction and transports the paper P drawn from the paper tray 22 toward the paper discharge opening 36. A drive motor (omitted in the diagram) which is controlled by the controller 26 is connected to the pickup roller and the transporting roller 142.

At the time of printing an image on a surface of the paper P by using the ink-jet printer 10, a drive signal associated with an image data is imparted from the controller 26 to each of the driver 126 of the FPC 50, the drive motor 138 of the drive mechanism 14, and the drive motor (omitted in the diagram) of the paper transporting section 24.

When the drive signal is imparted to the driver IC 126, a drive voltage is applied selectively from the driver IC 126 to the individual electrode 106 of the actuator unit 54. As the drive voltage is applied selectively from the driver IC 126, the active portion 100*a* is deformed, and a jetting pressure is applied to the ink in the pressure chamber 84 corresponding to that individual electrode 106. Accordingly, the ink is jetted from the nozzle 88 which communicates with that pressure chamber 88. When the drive signal is applied to the drive motor 138, by the rotation of the drive motor 138, the carriage 130 and the ink-jet head 12 mounted on the carriage 130 reciprocate in the vertical direction (in other words, in the main scanning direction X). Accordingly, the nozzles 88 of the ink-jet head 12 are moved in the vertical direction. When the drive signal is applied to the drive motor (omitted in the diagram) of the paper transporting section 24, the pickup roller (omitted in the diagram) is driven, and the paper P accommodated in the paper tray 22 is transported to the transporting roller 142 through transported path A. The paper P which has been transported is transported from the transporting roller 142 to the moving area for the ink jet head 12. By such operations, an image according to the image data is formed on the surface of the paper P.

At the time of stopping the operation of the ink-jet printer 10, a stop signal is inputted from the controller 26 to the drive motor 138. By the drive motor 138 being rotated according to the stop signal, the carriage 130 and the ink-jet head 12 mounted on the carriage 130 move to the standby position, and the ink-jet head 12 is positioned with respect to the nozzle cap 20.

As shown in FIG. 7, the maximum liquid-level heights t1 to t4 of the ink containers 16*a* to 16*d*, are positioned to be same as or lower than the heights T1 to T4 of the lowermost point of the nozzle in the ink-jet head 12 which is stopped at the standby position R. Therefore, it is possible to prevent the positive pressure due to the gravitational force from acting on the ink inside the ink-jet head 12 which is stopped at the standby position R, and to prevent the ink from leaking out from the nozzle 88.

The ink containers 16*a* to 16*d* are arranged to be aligned from the upper side to the lower side in the vertical direction, in the ascending order of the surface tensions of the inks accommodated in the ink containers 16*a* to 16*d*. Nozzles 88 corresponding to the ink containers 16*a* to 16*d* respectively are arranged to be aligned from the lower side to the upper side in the vertical direction in the ascending order of the surface tensions of the inks jetted from the nozzles 88. Therefore, the vertical interval (in other words, the water head difference) between the liquid level of the inks in the ink containers 16*a* to 16*d* and the lowermost points of the nozzles become small in proportion to the surface tension of the ink. Consequently, it is possible to prevent effectively the sucking of air into the nozzle 88, due to the excessive negative pressure.

Figure 8:
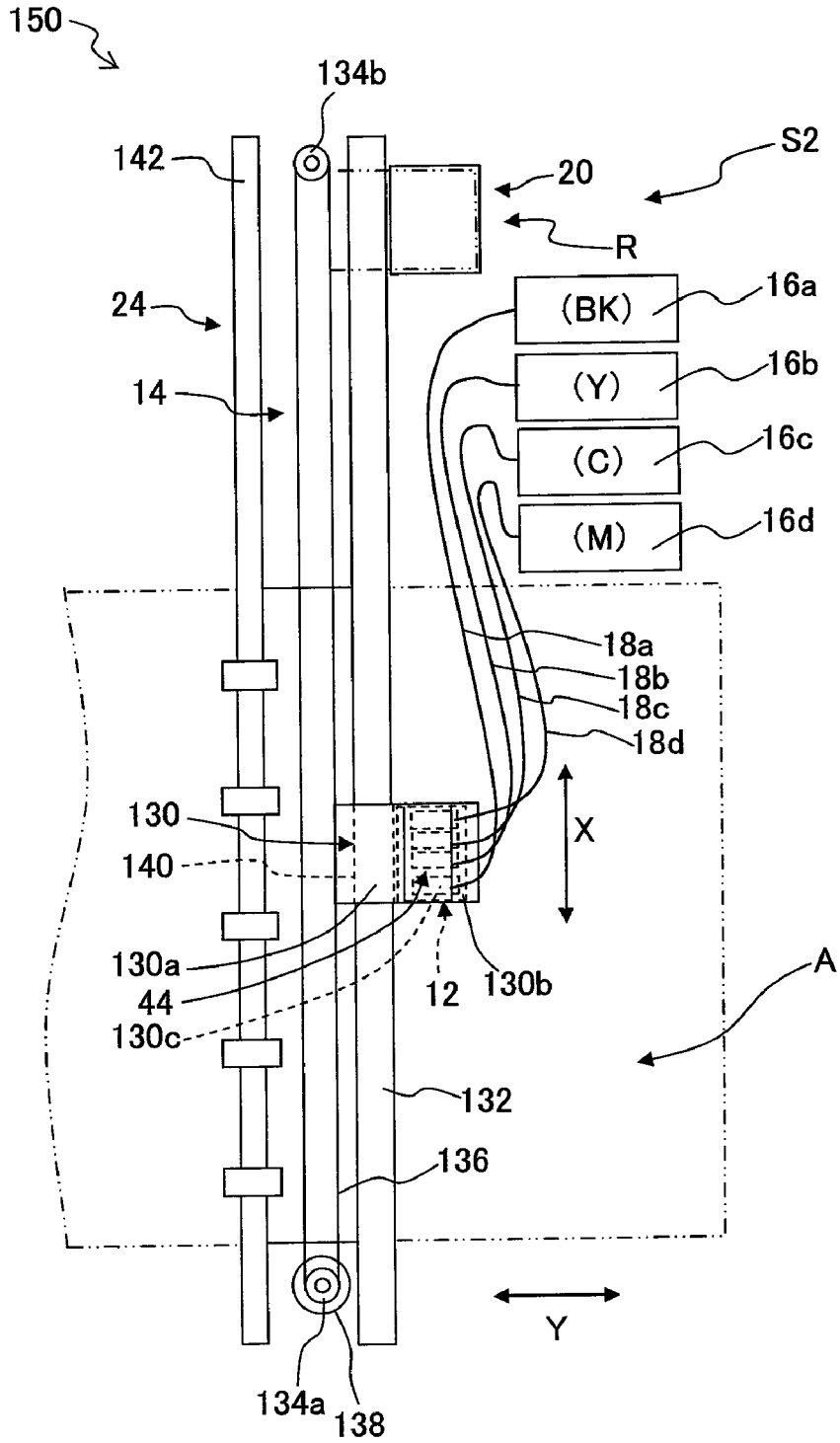
FIG. 8 is a simplified diagram showing a structure of an interior of an ink-jet printer according to a second embodiment of the present invention.

In an ink-jet printer 150 according to a second embodiment of the present invention, both the nozzle cap 20 and the ink containers 16*a* to 16*d* are arranged in an upper-side area S2 which is positioned at an upper side the transporting path A, as shown in FIG. 8. Consequently, both the ink-jet head 12 which is stopped at the standby position R and the ink containers 16*a* to 16*d* are arranged in the upper-side area S2. Rest of the structure is similar to the structure of the ink-jet printer 10 of the first embodiment.

Even in the ink-jet printer 150, as shown in FIG. 7, the maximum liquid-level heights t1 to t4 of the ink containers 16*a* to 16*d* are at positions same as or at lower side of the heights T1 to T4 of the lowermost point of the nozzle in the ink-jet head 12 which is stopped at the standby position R. Therefore, it is possible to prevent the ink from leaking out from the nozzle 88. Moreover, the ink containers 16*a* to 16*d* are arranged to be aligned from the upper side to the lower side in the vertical direction, in the ascending order of the surface tensions of the inks accommodated in the ink containers 16*a* to 16*d*. Furthermore, the nozzles 88 corresponding to the ink containers 16*a* to 16*d* respectively are arranged to be aligned from the lower side to the upper side in the vertical direction, in the ascending order of the surface tensions of the inks jetted from the nozzles 88. Consequently, lower the surface tensions of the inks, smaller is the vertical interval (the water head difference) between the level of the ink in the ink container and the lowermost point of the nozzle. Accordingly, it is possible to prevent the excessive negative pressure due to the gravitational force from acting on the ink in the ink-jet head 12, and to prevent effectively the degradation of the jetting characteristics due to the sucking of air into the nozzle 88.

Figure 9:
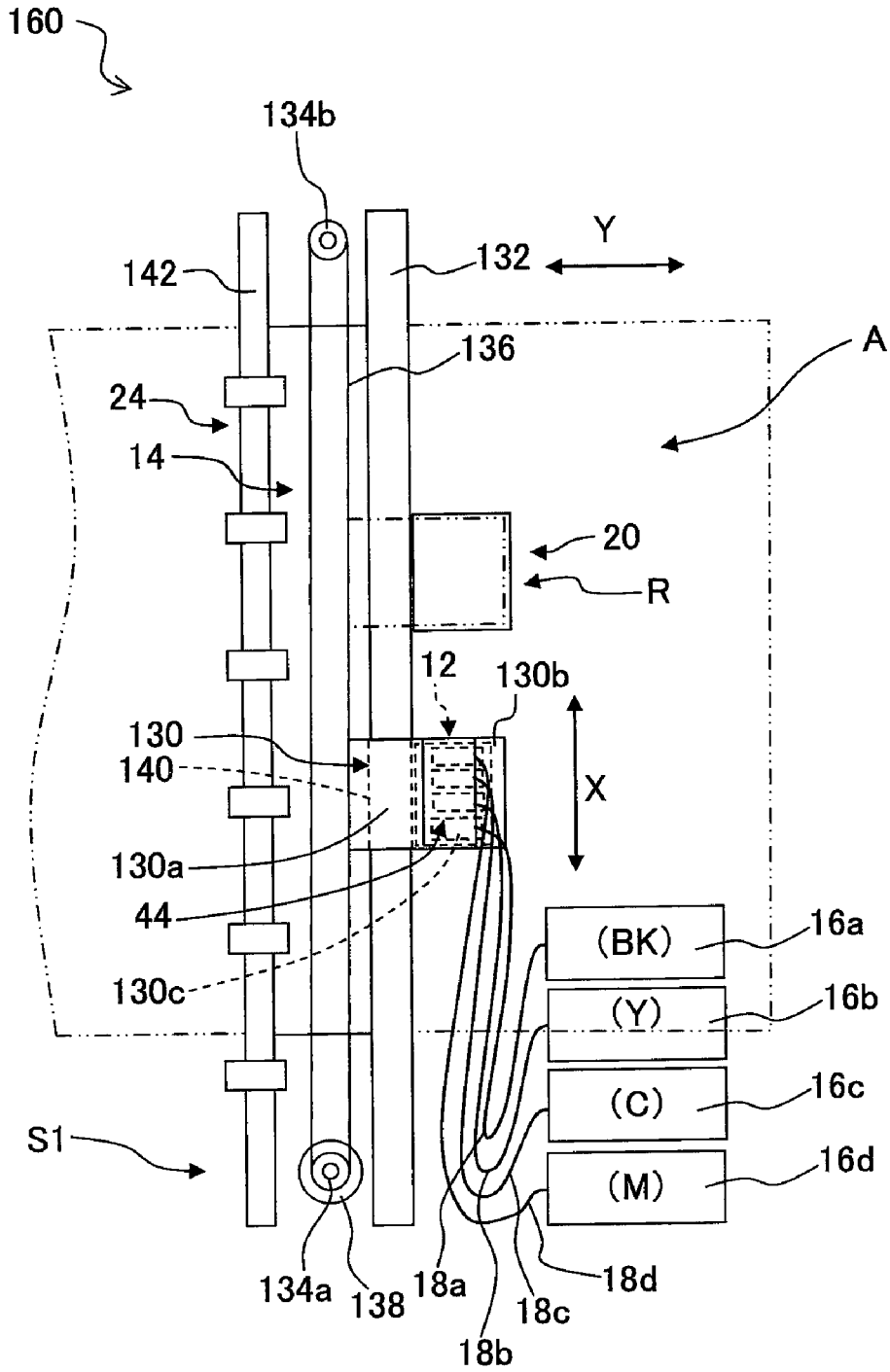
FIG. 9 is a simplified diagram showing a structure of an interior of an ink-jet printer according to a third embodiment of the present invention.

As shown in FIG. 9, in an ink-jet printer according to a third embodiment of the present invention, the nozzle cap 20 is arranged in an area overlapping with the transporting path A, and the ink containers 16*a* to 16*d* are arranged in an area spread over the transporting path A and the lower-side area S1. Rest of the structure is similar to the structure of the ink-jet printer 10 of the first embodiment.

As shown in FIG. 7, even in the ink-jet printer 160, the maximum liquid-level heights t1 to t4 of the ink containers 16*a* to 16*d* are same as or at a lower side of the heights T1 to T4 of the lowermost point of the nozzle in the ink-jet head 12 which is stopped at the standby position R. Therefore, it is possible to prevent the ink from leaking out from the nozzle 88. Moreover, the ink containers 16*a* to 16*d* are arranged to be aligned from the upper side to the lower side in the vertical direction, in the ascending order of the surface tensions of the inks accommodated in the ink containers 16*a* to 16*d*. Furthermore, the nozzles 88 corresponding to the ink containers 16*a* to 16*d* respectively are arranged to be aligned from the lower side to the upper side in the vertical direction in the ascending order of the surface tensions of the inks jetted from the nozzles 88. Therefore, lower the surface tensions of the inks, smaller is the water head difference, and it is possible to prevent the excessive negative force due to the gravitational force from acting on the inks in the ink jet head 12. Consequently, it is possible to prevent effectively the degradation of the jetting characteristics due to the sucking of air into the nozzle 88.

Figure 10:
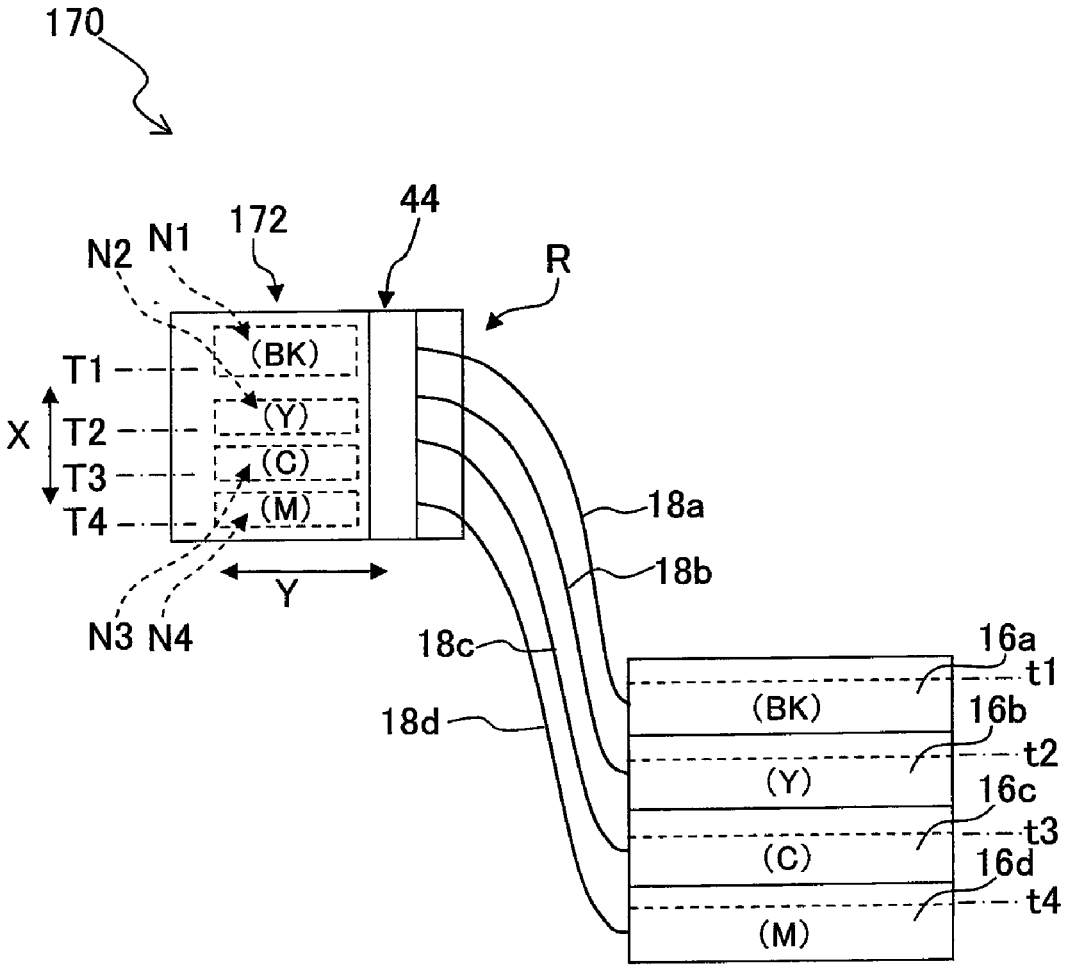
FIG. 10 is a schematic diagram showing main components of an ink jet printer according to a fourth embodiment of the present invention.

As shown in FIG. 10, in an ink-jet printer 170 according to a fourth embodiment of the present invention, the ink channels N1 to N4 in an ink-jet head 172 are arranged to be aligned from the upper side to the lower side in the vertical direction, in the ascending order of the surface tensions of the inks flowing through the ink channels N1 to N4. In other words, the nozzles 88 corresponding to the ink containers 16*a* to 16*d* are arranged to be aligned from the upper side to the lower side in the vertical direction in the ascending order of the surface tensions of the inks jetted from the nozzles 88. Rest of the structure is similar to the structure of the ink-jet printer 10 of the first embodiment.

Even in the ink-jet printer 170, the maximum liquid-level heights t1 to t4 of the ink containers 16*a* to 16*d* are positioned same as or at lower side of the heights T1 to T4 of the lowermost points of the nozzles in the ink-jet head 172 which is stopped at the standby position R. Therefore, it is possible to prevent the inks from leaking out from the nozzles 88. Moreover, the ink containers 16*a* to 16*d* are arranged to be aligned from the upper side to the lower side in the vertical direction in the ascending order of the surface tensions of the inks accommodated in the ink containers 16*a* to 16*d*. Consequently, lower the surface tension of the ink, smaller is the water head difference, and it is possible to prevent the excessive negative pressure due to the gravitation force from acting on the ink in the ink-jet head 172. Consequently, it is possible to prevent effectively the degradation of the jetting characteristics due to the sucking of air into the nozzle 80.

Figure 11:
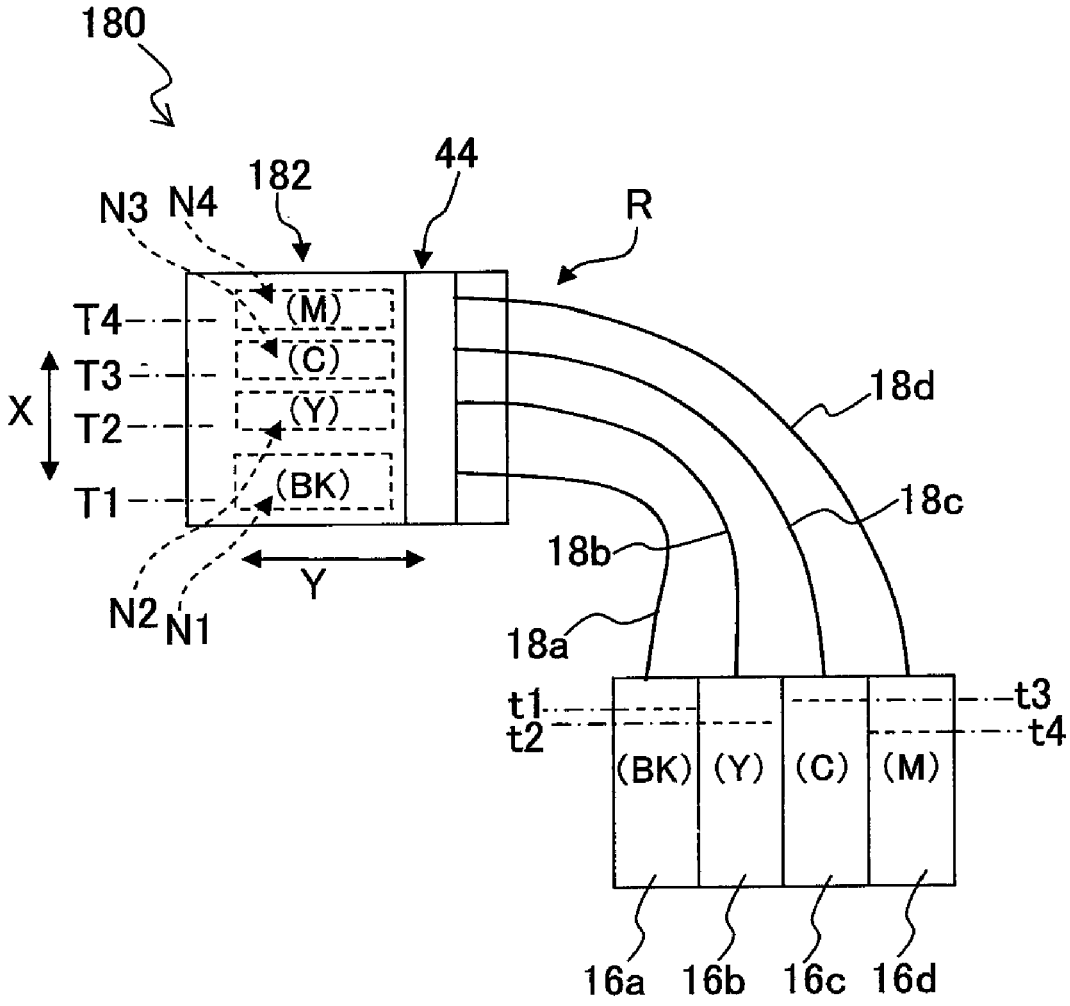
FIG. 11 is a schematic diagram showing main components of an ink jet printer according to a fifth embodiment of the present invention.

As shown in FIG. 11, in an ink jet printer 180 according to a fifth embodiment of the present invention, the ink containers 16*a* and 16*d* are arranged to be aligned in the horizontal direction, and the ink channels N1 to N4 in an ink-jet head 182 are arranged to be aligned from the lower side to the upper side in the vertical direction, in the ascending order of the surface tensions of the inks flowing through the ink channels N1 to N4. In other words, the nozzles 88 (FIG. 5 and FIG. 6) corresponding to the ink containers 16*a* to 16*d* respectively, are arranged to be aligned from the lower side to the upper side in the vertical direction, in the ascending order of the surface tensions of the inks jetted from the nozzles 88. Rest of the structure is similar to the structure of the ink-jet printer 10 of the first embodiment.

Even in the ink-jet printer 180, the maximum liquid-level heights t1 to t4 of the ink containers 16*a* to 16*d* are at positions same as or at lower side of the heights T1 to T4 of the lowermost points of the nozzles in the ink-jet head 182 which is stopped at the standby position R. Therefore, it is possible to prevent the inks from leaking out from the nozzles 88. Moreover, the nozzles 88 corresponding to the ink containers 16*a* to 16*d* respectively are arranged to be aligned from the lower side to the upper side in the vertical direction in the ascending order of the surface tensions of the inks jetted from the nozzles 88. Consequently, lower the surface tensions of the inks, smaller is the water head difference, and it is possible to prevent the excessive negative pressure exerted due to the gravitational force from acting on the inks in the ink-jet head 182. Consequently, it is possible to prevent effectively the degradation of the jetting characteristics due to the sucking of air into the nozzle 88.

In the embodiments described above, the description has been made by citing an ink-jet printer which jets inks of four colors, as an example. However, the present invention is also applicable to an ink jet printer which jets inks of three colors or five colors or even more than five colors. Moreover, the present invention is also applicable to a monochrome (black and white) ink-jet printer which jets inks of two colors namely a black pigment ink (hereinafter, called as "pigment BK") and a black dye ink (hereinafter, called as "dye BK"). For example, in a case of applying the present invention to the monochrome (black and white) ink-jet printer, when a surface tension of the dye BK is lower than a surface tension of the pigment BK, in an ink-jet head, an ink channel for the dye BK is arranged at a lower side in a vertical direction than an ink channel for the pigment BK, and regarding two ink containers (for the pigment BK and the dye BK), the ink container which contains the dye BK is arranged at an upper side in the vertical direction of the ink container which contains the pigment BK.

In each of the embodiments described above, the present invention is applicable to an ink-jet printer of a type in which an ink (a liquid) is jetted by using an actuator. However, the present invention is also applicable widely to other liquid jetting apparatuses such as an ink-jet printer of a type in which an ink (a liquid) is jetted by using a pressure when heated by a heating element (an exothermic body), a color filter manufacturing apparatus which includes a colored-liquid jetting head which jets a colored liquid (a liquid), and an electrical wiring apparatus which includes an electroconductive-liquid jetting head which jets an electroconductive liquid (a liquid).

What is claimed is:

1. A liquid jetting apparatus which jets a liquid onto a jetting objective, comprising:

a liquid jetting head having a nozzle which jets the liquid;

a drive mechanism which reciprocately moves the liquid jetting head in a vertical direction to move the nozzle in the vertical direction;

a nozzle protective member which is arranged in a moving area for the liquid jetting head and which protects the nozzle of the liquid jetting head;

a controller which controls the drive mechanism to stop the liquid jetting head at a standby position which faces the nozzle protective member;

a liquid container which contains the liquid; and a liquid tube which supplies the liquid in the liquid container to the liquid jetting head;

wherein the liquid container is installed at a predetermined position fixed in the vertical direction of the liquid jetting apparatus such that, when the liquid container is filled with the liquid at a maximum capacity thereof, a position of a liquid level of the liquid in the liquid container is same as or lower than a position of a lowermost point of the nozzle in the liquid jetting head which is stopped at the standby position.

2. The liquid jetting apparatus according to claim 1, further comprising;

a transporting mechanism which has a rotating shaft extending in the vertical direction and transports the jetting objective in a horizontal direction, wherein both the liquid jetting head which is stopped at the standby position and the liquid container are arranged at positions above or below a transporting path through which the jetting objective is transported in a direction orthogonal to the vertical direction in which the nozzle is moved.

3. The liquid jetting apparatus according to claim 1;

wherein the liquid container is provided as a plurality of liquid containers in which a plurality of liquids having different surface tension are contained respectively;

wherein the nozzle is formed as a plurality of nozzle rows each of which extends in a horizontal direction and is associated with one of the liquid containers;

wherein the liquid tube is provided as a plurality of liquid tubes which supply the liquids contained in the liquid containers to the nozzle rows corresponding to the containers, respectively; and wherein the liquid containers are aligned downwardly in the vertical direction in an ascending order of the surface tensions of the liquids contained in the liquid containers.

4. The liquid jetting apparatus according to claim 3;

wherein a black ink is included in the liquids, and a liquid container, among the liquid containers, arranged at uppermost position in the vertical direction contains the black ink.

5. The liquid jetting apparatus according to claim 3;

wherein the nozzle rows are aligned upwardly in the vertical direction in an ascending order of the surface tensions of the liquids to be jetted from the nozzles, respectively.

6. The liquid jetting apparatus according to claim 5;

wherein a black ink is included in the liquids, and the black ink is jetted from a nozzle row, among the nozzle rows, arranged at lowermost position in the vertical direction.

7. The liquid jetting apparatus according to claim 1;

wherein the nozzle protective member is a nozzle cap which covers the nozzle.

8. A liquid jetting apparatus which jets a liquid onto a jetting objective, comprising:

a liquid jetting head having a nozzle which jets the liquid onto the jetting objective;

a drive mechanism which reciprocately moves the liquid jetting head in a vertical direction to move the nozzle in the vertical direction;

a nozzle protective member which is arranged in a moving area for the liquid jetting head and which protects the nozzle of the liquid jetting head;

a controller which controls the drive mechanism to stop the liquid jetting head at a standby position facing the nozzle protective member;

a liquid container which contains the liquid and which is installed at a predetermined position fixed in the vertical direction of the liquid jetting apparatus; and a liquid tube which supplies the liquid in the liquid container to the liquid jetting head;

wherein both the liquid jetting head which is stopped at the standby position and the liquid container are arranged at one of an upper side and a lower side of a transporting path through which the jetting objective is transported in a horizontal direction.

9. The liquid jetting apparatus according to claim 8;

wherein both the liquid jetting head which is stopped at the standby position and the liquid container are arranged at the lower side of the transporting path.

10. The liquid jetting apparatus according to claim 8, further comprising:

a transporting mechanism which has a rotating shaft extending in the vertical direction and transports the jetting objective in a horizontal direction.

* * * * *